US008323075B2

(12) United States Patent
Masumura et al.

(10) Patent No.: US 8,323,075 B2
(45) Date of Patent: Dec. 4, 2012

(54) POLISHING HEAD, POLISHING APPARATUS AND METHOD FOR DEMOUNTING WORKPIECE

(75) Inventors: Hisashi Masumura, Nishishirakawa (JP); Koji Kitagawa, Nishishirakawa (JP); Kouji Morita, Nishishirakawa (JP); Hiromi Kishida, Nagano (JP); Satoru Arakawa, Nagano (JP)

(73) Assignees: Shin-Etsu Handotai Co., Ltd., Tokyo (JP); Fujikoshi Machinery Corp., Nagano (JP)

( * ) Notice: Subject to any disclaimer, the term of this patent is extended or adjusted under 35 U.S.C. 154(b) by 365 days.

(21) Appl. No.: 12/734,119

(22) PCT Filed: Nov. 21, 2007

(86) PCT No.: PCT/JP2007/001282

§ 371 (c)(1),
(2), (4) Date: Apr. 12, 2010

(87) PCT Pub. No.: WO2009/066355

PCT Pub. Date: May 28, 2009

(65) Prior Publication Data

US 2010/0233945 A1 Sep. 16, 2010

(51) Int. Cl.
*B24B 5/00* (2006.01)
*B24B 41/06* (2012.01)

(52) U.S. Cl. ..... 451/288; 451/364; 451/41

(58) Field of Classification Search ..... 451/25, 451/364, 397, 398, 285–289, 41
See application file for complete search history.

(56) References Cited

U.S. PATENT DOCUMENTS

| | | | |
|---|---|---|---|
| 5,443,416 | A | 8/1995 | Volodarsky et al. |
| 5,527,209 | A | 6/1996 | Volodarsky et al. |
| 6,196,906 | B1 | 3/2001 | Hakomori |
| 2002/0049024 | A1 | 4/2002 | Zuniga et al. |
| 2003/0232581 | A1 | 12/2003 | Ki |

FOREIGN PATENT DOCUMENTS

| | | |
|---|---|---|
| EP | 1 048 407 A2 | 11/2000 |
| JP | A-62-199388 | 9/1987 |

(Continued)

OTHER PUBLICATIONS

Singaporean Office Action issued in Application No. 201003250-6; Dated Jul. 21, 2011.

(Continued)

*Primary Examiner* — Dung Van Nguyen
(74) *Attorney, Agent, or Firm* — Oliff & Berridge, PLC

(57) ABSTRACT

A polishing head having a disklike carrier in which an annular projecting portion and a carrier-engagement portion are formed in a peripheral portion, a disklike head body in which a head-body-engagement portion is formed outside, a diaphragm for connecting the head body with the carrier, a spacer located between the carrier-engagement portion and the head-body-engagement portion in a part of the carrier-engagement portion and/or the head-body-engagement portion, in which the spacer abuts on the carrier-engagement portion and/or the head-body-engagement portion at the time of lifting the head body so that the workpiece is demounted from the polishing pad by lifting the carrier with it inclined. As a result, there is provided a polishing head in which the workpiece can be easily, safely and surely demounted from the polishing pad by lifting the polishing head holding the workpiece without overhanging the polishing head from the turn table and the like.

16 Claims, 8 Drawing Sheets

FOREIGN PATENT DOCUMENTS

| | | |
|---|---|---|
| JP | A-8-290358 | 11/1996 |
| JP | A-11-320388 | 11/1999 |
| JP | A-2000-323445 | 11/2000 |
| JP | A-2001-341070 | 12/2001 |

OTHER PUBLICATIONS

Aug. 18, 2011 Office Action issued in Chinese Application No. 200780101147.8 (with partial translation).

Singaporean Search Report issued in Application No. 201003250-6; Dated Dec. 17, 2010.

Singaporean Written Opinion issued in Application No. 201003250-6; Dated Dec. 17, 2010.

International Search Report mailed Feb. 26, 2008 for International Application No. PCT/JP2007/001282.

Jun. 8, 2010 International Preliminary Report on Patentability issued in corresponding International Patent Application No. PCT/JP2007/001282.

Jun. 6, 2012 Chinese Office Action issued in Chinese Patent Application No. 200780101147.8 (with English-language Translation).

(a)

(b)

(a)

(b)

(c)

POLISHING HEAD, POLISHING APPARATUS AND METHOD FOR DEMOUNTING WORKPIECE

TECHNICAL FIELD

The present invention relates to a polishing head for holding a back surface of a workpiece when a front surface of the workpiece is polished, a polishing apparatus having it, and a method for demounting the workpiece from a polishing pad.

BACKGROUND ART

As an apparatus for polishing a surface of a semiconductor wafer such as a silicon wafer, there are a single-side polishing apparatus, in which the workpiece is polished by each side, and a double-side polishing apparatus, in which the both sides of the workpiece are polished at the same time.

For example as shown in FIG. 10, a common single-side polishing apparatus comprises a turn table 73 onto which a polishing pad 74 is attached, a polishing agent supply mechanism 76, a polishing head 72 and the like. The polishing apparatus 71 polishes a wafer W by holding the wafer W with the polishing head 72, supplying the polishing agent 75 to the polishing pad 74 through the polishing agent supply mechanism 76, rotating the turn table 73 and the polishing head 72 respectively, and bringing the surface of the wafer W into sliding contact with the polishing pad 74.

As a method for holding the workpiece, there are a method of sticking the workpiece on a flat disklike plate with an adhesive such as wax, a method of sticking with water the workpiece on a soft pad (a backing pad), a method of sucking the workpiece with vacuum, or the like.

FIG. 11 illustrates a schematic example of a polishing head holding the workpiece with the backing pad. This polishing head 91 has the backing pad 95 that is made of polyurethane and the like and is attached on the lower face of a disklike carrier 92 made of ceramic or the like. The pad 95 is caused to absorb with water to hold the workpiece W with surface tension. In addition, in order to prevent the workpiece W from coming off from the carrier 92 during the polishing, a ring-shaped template 94 is provided around the carrier 92.

In the case of polishing a large diameter workpiece, such as a silicon single crystal wafer particularly having a diameter of 300 mm, using a plane polishing pad without a groove, there is a problem such that when the polishing head is lifted to attempt to demount the workpiece from the polishing pad after polishing the workpiece, the polished workpiece adheres to a surface of the polishing pad due to surface tension of the polishing agent and thereby the workpiece remains on the polishing pad. In addition, there is a problem such that when suction power of the polishing head for the workpiece excessively increases, such a load that lifts the turn table is added to bearing parts that fix the turn table.

In view of the problems, for example, a method is adopted in which the suction power of the polishing pad is reduced by forming a groove on the polishing pad or in which the polishing head is lifted after the polishing head is overhung from the turn table once (hereinafter referred to as an overhang method. For example, see Japanese Patent Application Laid-open (kokai) No. 2001-341070).

However, in the case of forming the groove on the polishing pad, there are quality problems such that minute waviness occurs on the surface of the workpiece due to transfer of the groove of the polishing pad, an edge of the workpiece is caught in the groove part to be damaged, an outer peripheral sag occurs or the like. Besides, in the overhang method there are problems that a size of the apparatus becomes large to keep a space for overhanging the polishing head and the like.

DISCLOSURE OF INVENTION

In view of the above-explained problems, it is an object of the present invention to provide a polishing head in which the workpiece can be easily, safely and surely demounted from the polishing pad by lifting the polishing head holding the workpiece without overhanging the polishing head from the turn table or forming the groove on the polishing pad.

In order to accomplish the above object, the present invention provides a polishing head having at least a disklike carrier for holding a back surface of a workpiece in which an annular projecting portion that projects upward and an annular carrier-engagement portion that overhangs inward from the projecting portion are formed in a peripheral portion, a head body for holding the carrier in which a space portion is formed inside and an annular head-body-engagement portion that overhangs outward is formed outside, the head body being rotatable, and a diaphragm for connecting the head body with the carrier and sealing the space portion of the head body; the polishing head holding the back surface of the workpiece with the carrier in condition where pressure of the sealed space portion is adjusted with a pressure adjustment mechanism connected with the space portion in the case of polishing a front surface of the workpiece by bringing into sliding contact with a polishing pad attached onto a turn table, and demounting the workpiece from the polishing pad by lifting the head body and the carrier-engagement portion with the carrier-engagement portion hooked on the head-body-engagement portion in the case of demounting the workpiece from the polishing pad by lifting the polishing head after polishing the workpiece; wherein a spacer located at least between the carrier-engagement portion and the head-body-engagement portion is provided in a part of the carrier-engagement portion and/or the head-body-engagement portion and the spacer abuts on the carrier-engagement portion and/or the head-body-engagement portion at the time of lifting the head body so that the workpiece is demounted from the polishing pad by lifting the carrier with it inclined in the case of demounting the workpiece from the polishing pad by lifting the polishing head.

When the workpiece is polished and demounted from the polishing pad after polishing the workpiece using the polishing head described above, the workpiece can be easily, safely and surely demounted from the polishing pad. In addition, since inclination angle at the time of lifting the polishing head can be adjusted by adjusting a thickness of the spacer, inclination angle of the polishing head can be adjusted by an easy operation. Furthermore, quality of the polished surface of the workpiece does not deteriorate unlike the method of forming the groove on the polishing pad, and it is not necessary that a polishing apparatus is large unlike the overhang method.

In this case, it is preferable that the polishing head has a backing pad on a face of the carrier, the face holding the back surface of the workpiece.

In this manner, when the polishing head has a backing pad on the face of the carrier, the face holding the back surface of the workpiece, the carrier can surely hold the workpiece. Use of the polishing head described above thereby enables more surely demounting the workpiece from the polishing pad.

In addition, the carrier may be capable of holding a semiconductor wafer having a diameter of 300 mm or more as the workpiece.

In this manner, even if the carrier holds a semiconductor wafer having a diameter of 300 mm or more as the workpiece, the semiconductor wafer which has a strong force to adhere to the polishing pad after polishing, the workpiece can be easily, safely and surely demounted from the polishing pad using the polishing head according to the present invention.

The present invention furthermore provides a polishing apparatus used for polishing a surface of a workpiece at least including: a polishing pad attached onto a turn table; a polishing agent supply mechanism for providing a polishing agent to the polishing pad; and a polishing head for holding the workpiece, which is the polishing head according to the present invention.

In this manner, when the workpiece is polished and demounted from the polishing pad after polishing the workpiece using the polishing apparatus including the polishing head according to the present invention, the polishing apparatus can easily, safely and surely demount the workpiece from the polishing pad. In addition, quality of the polished surface of the workpiece does not deteriorate unlike the method of forming the groove on the polishing pad, and it is not necessary that a polishing apparatus is large unlike the overhang method.

In this case, it is preferable that the polishing apparatus has a mechanism for automatically adjusting a stopping position of rotation of the polishing head.

In this manner, when the polishing apparatus has the mechanism for automatically adjusting the stopping position of rotation of the polishing head, the polishing apparatus can adjust the rotation angle position of the polishing head to the position where the wafer is more easily demounted and stop the polishing head at an appropriate position.

The present invention furthermore provides a method for demounting a workpiece from a polishing pad after dressing the polishing pad attached onto a turn table and bringing a surface of the workpiece into sliding contact with the dressed polishing pad to polish, including the steps of: holding and polishing the workpiece with the polishing head according to the present invention; stopping rotation of the polishing head in such a manner that a rotational position of the spacer from a center of the polishing head is within 30° with respect to a center of the polishing pad; and demounting the workpiece by lifting the head body at the rotational position.

In this manner, the method of dressing the polishing pad, polishing the front surface of the workpiece with the polishing head according to the present invention, stopping rotation of the polishing head in such a manner that the rotational position of the spacer from the center of the polishing head is within 30° with respect to the center of the polishing pad after polishing the workpiece and demounting the workpiece from the polishing pad enables more easily, safely and surely demounting the workpiece from the polishing pad. In addition, quality of the polished surface of the workpiece does not deteriorate unlike the method of forming the groove on the polishing pad, and it is not necessary that a polishing apparatus is large unlike the overhang method.

Use of the polishing head according to the present invention enables easily, safely and surely demounting the workpiece from the polishing pad without deteriorating quality of the polished surface of the workpiece at the time of demounting the workpiece from the polishing pad after polishing the workpiece. In addition, since inclination angle at the time of lifting the polishing head can be adjusted by adjusting the thickness of the spacer, the inclination angle of the polishing head can be adjusted by an easy operation and demounting conditions of a wafer can be also easily adjusted.

In addition, polishing the workpiece with the polishing head according to the present invention after dressing, stopping rotation of the polishing head in such a manner that the spacer corresponds to the vicinity of a center of the turn table and demounting the workpiece from the polishing pad enable more easily, safely and surely demounting the workpiece from the polishing pad.

BEST MODES FOR CARRYING OUT THE INVENTION

Hereinafter, the present invention is now explained more specifically.

As described above, in the case of polishing a large diameter workpiece using the polishing pad without the groove, there is a problem such that when the polishing head is lifted to attempt to demount (also referred to as to separate or to rip away) the workpiece from the polishing pad after polishing the workpiece, the polished workpiece adheres to the surface of the polishing pad and thereby the workpiece remains on the polishing pad.

In view of the problems, the present inventors have keenly studied on a method for easily demounting the workpiece from the polishing pad without using the method of forming the groove on the polishing pad or the overhang method.

The present inventors found through the studies that when the polishing head holding the workpiece is lifted, the workpiece can be demounted by applying force in a focused manner to a specific area in a workpiece holding face of the carrier, on which the back surface (the opposite side of the surface to be polished) of the workpiece is held, by inclining and by lifting the polishing head. Moreover, the present inventors found that the center of the polishing pad takes the form of being lower than its periphery and having a hollow when the dressing is performed using a normal method. Furthermore, the present inventors convinced that at the time of demounting the workpiece from the polishing pad after polishing, the workpiece can be more easily demounted from the polishing pad by demounting the workpiece from the polishing pad with force applied to the vicinity of the hollow located in the center of the polishing pad and thereby accomplished the present invention.

Hereinafter, a polishing head and a polishing apparatus according to the present invention are now explained specifically referring to the attached figures. However, the present invention is not limited thereto.

Figure 1:
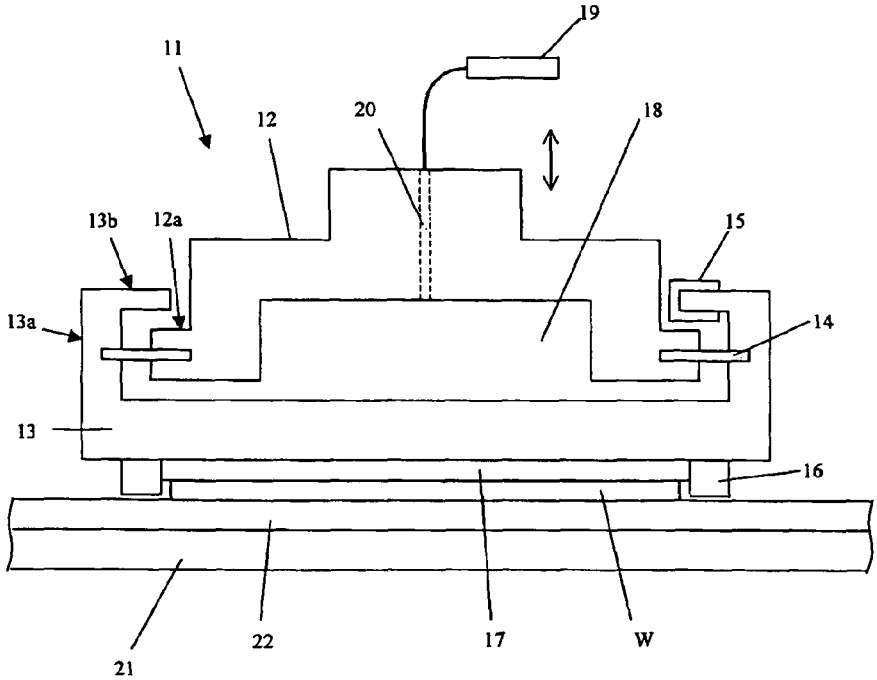
FIG. 1 is a schematic sectional view showing a first embodiment of the polishing head according to the present invention.

FIG. 1 shows an embodiment of the polishing head according to the present invention (a first embodiment). The polishing head 11 according to the present invention comprises a later-explained spacer 15. First, a general structure is explained. The polishing head 11 has a head body 12. A space portion 18 is formed inside the head body 12. The head body 12 is rotatable and has a through hole 20 for pressure adjustment communicating with a pressure adjustment mechanism 19 at a center of its upper part.

The head body 12 is connected with a disklike carrier 13 through a diaphragm 14, the carrier being concentrically placed. By the connection through the diaphragm 14, the head body 12 holds the carrier 13 and the space portion 18 of the head body 12 is sealed.

A means for a vertical motion, not shown, causes the head body 12 to vertically move.

The carrier 13 is used to hold the back surface (the opposite side of the surface to be polished) of the workpiece W. For example, the carrier 13 can be used in which the holding face is flat, its stiffness is high and metal contamination of the workpiece W is not brought about. A circular plate made of ceramic, such as alumina, is preferably used for the carrier. Other than that, various carriers can be used such as a so-called rubber chuck carrier, which is described later.

Moreover, it is preferable that a diameter of the workpiece holding face of the carrier 13 is the same as a diameter of the workpiece W to be polished or is slightly larger than a diameter of the workpiece W in order to support the whole of the back surface of the workpiece W.

A high elasticity material can be preferably used as the diaphragm 14, such as elastomer and rubber. A sheet of the diaphragm 14 made of the material as described above is fixed to the head body 12 and the carrier 13 using screws and the like respectively so that the head body, the carrier and the diaphragm are connected and the space portion 18 of the head body 12 is sealed.

Figure 9:
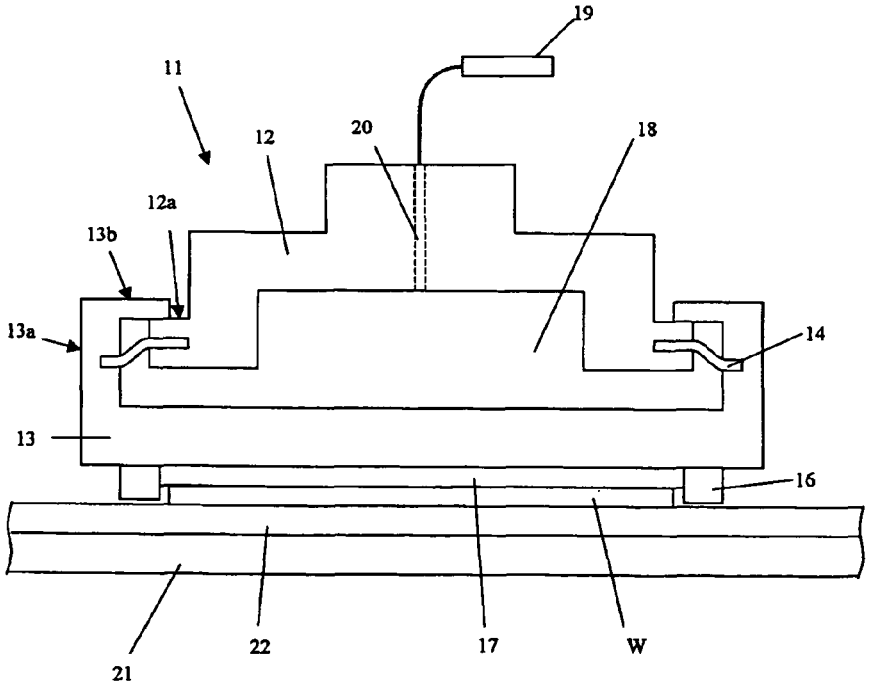
FIG. 9 is a schematic sectional view showing a movement at the time of demounting the workpiece from the polishing pad by lifting the polishing head at a position where there is no spacer.
Figure 10:
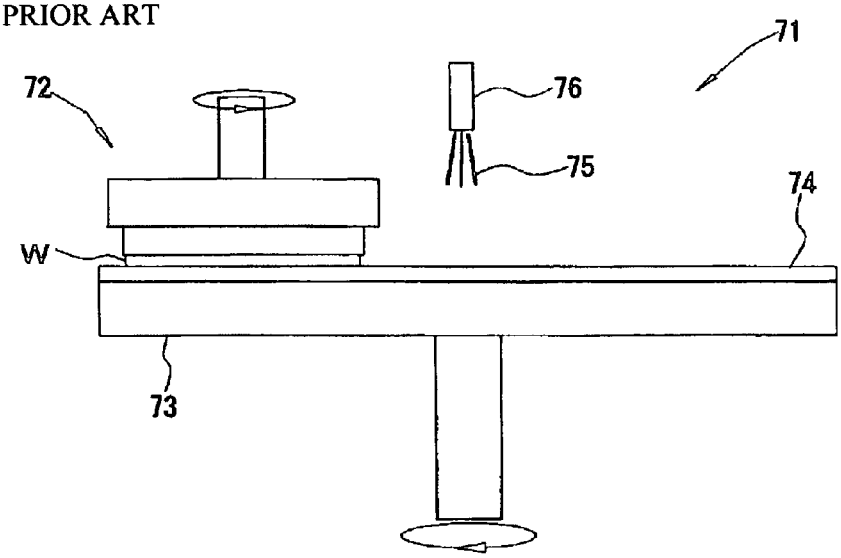
FIG. 10 PRIOR ART
FIG. 10 is a schematic constitutional view showing an example of a single-side polishing apparatus.
Figure 11:
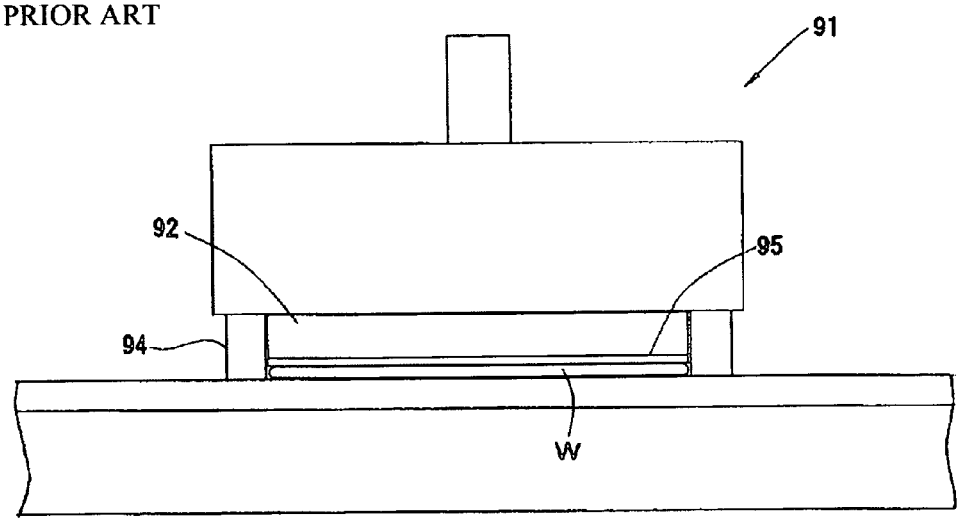
FIG. 11 PRIOR ART
FIG. 11 is a schematic constitutional view showing an example of a conventional polishing head.

An annular head-body-engagement portion 12*a* that overhangs outward is formed outside in the head body 12. An annular projecting portion 13*a* that projects upward and an annular carrier-engagement portion 13*b* are formed in the carrier 13. An outer diameter of the head-body-engagement portion 12*a* is larger than an inner diameter of the carrier-engagement portion 13*b*. As shown in FIG. 9, when the head body 12 is lifted to demount the workpiece from the polishing pad, an annular abutting face of the head-body-engagement portion 12*a* and the carrier-engagement portion 13*b* is hooked on one another at a position where there is no spacer. Practically, since the spacer 15 is provided, there is also an area having a gap between the head-body-engagement portion 12*a* and the carrier-engagement portion 13*b* but the area is not shown in the figure.

In order to make the head body 12 vertically movable, the projecting portion 13*a* of the carrier needs to projects up to a higher position than the head-body-engagement portion 12*a* and its inner diameter needs to be larger than the outer diameter of the head-body-engagement portion 12*a*. A portion inside the projecting portion 13*a* of the carrier 13 is not necessarily flat and can be a convex shape entering into the space portion 18 of the head body 12.

Figure 12:
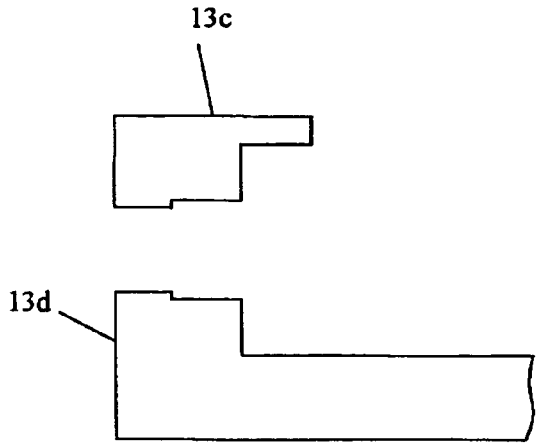
FIG. 12 are schematic sectional views showing an example of a method for assembling the polishing head according to the present invention.
Figure 12:
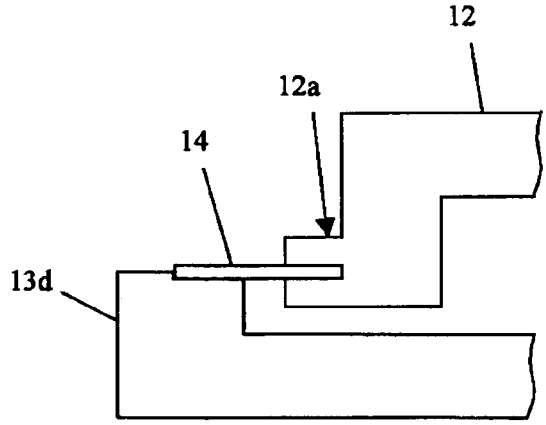
Figure 12:
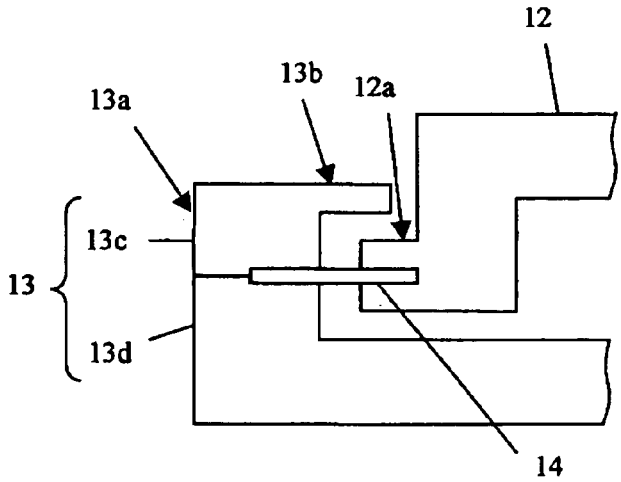

The positional relationship between the head body 12 and the carrier 13 as described above can be achieved by the method as shown in FIG. 12, but the present invention is not restricted thereto.

First, for the carrier 13, a first member 13*c*, which consists of a part of the annular projecting portion 13*a* and the carrier-engagement portion 13*b*, and a second member 13*d*, which consists of other portions, mainly a disklike portion, are separately prepared (FIG. 12(*a*)). Next, the head body 12 to which the diaphragm 14 is fixed using screws and the like is placed above the second member 13*d* (FIG. 12(*b*)). Next, the first member 13*c* is fixed onto the second member 13*d* using screws and the like and consequently it becomes the carrier 13 (FIG. 12(*c*)). It is to be noted that the diaphragm 14 can be fixed to the carrier 13 using the same screws that fix the first member 13*c* to the second member 13*d*.

It is to be noted that when the carrier 13 and the head body 12 are connected between the projecting portion 13*a* of the carrier 13 and the head-body-engagement portion 12*a* through the diaphragm 14, its structure becomes simple and therefore it is preferable. However, the present invention is not restricted thereto.

A backing pad 17 is preferably provided on the face (the holding face) of the carrier 13 on which the back surface of the workpiece W is held. For example, the backing pad 17 made of foamed polyurethane is fixed to the holding face of the carrier 13 with an adhesive double coated tape and the like. By providing such backing pad 17 and having it contain water, the workpiece W can be more surely held by surface tension of the water contained in the backing pad 17.

A template 16 can be provided in peripheral portion of the carrier 13, that is, outside the workpiece holding face. The template 16 is used to hold an edge portion of the workpiece W and is placed with projecting downward along the peripheral portion of the carrier 13. The template 16 holds the edge portion of the workpiece so that the workpiece is prevented from coming off from the carrier 13 while the template 16 does not press the polishing pad 22. The template 16 is preferably made of a material that does not contaminates the workpiece W and is softer than the workpiece W for the purpose of not generating scratches or impressions.

A dress ring, not shown, can be placed in the periphery of the template 16, the dress ring which presses the polishing pad 22 during polishing to prevent waviness deformation of the polishing pad 22. The dress ring is preferably made of a material that does not cause metal contamination in the workpiece W, and that wears as less as possible upon contact with the polishing pad 22. For example, a ring made of alumina is preferably used.

Figure 2:
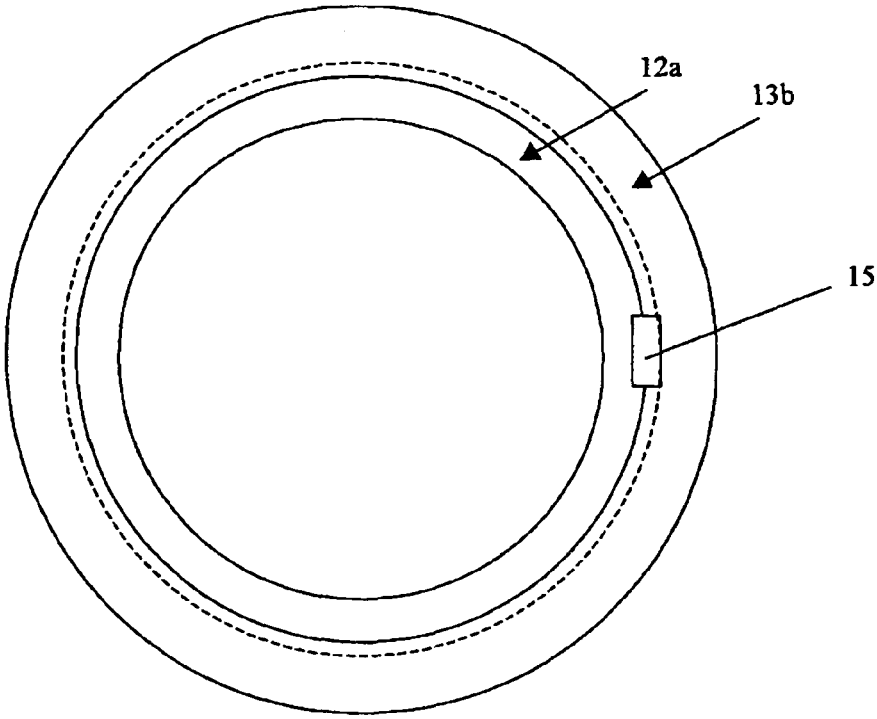
FIG. 2 is a schematic top view showing an example of the polishing head according to the present invention.

As shown in FIG. 1, the polishing head 11 according to the present invention having the above-mentioned general structure provides with a spacer 15 located at least between the carrier-engagement portion and the head-body-engagement portion in a part of at least either of the carrier-engagement portion or the head-body-engagement portion. The spacer 15 is fixed to the carrier-engagement portion 13*b* using screws and the like in the embodiment in FIG. 1. It is to be noted that as shown in FIG. 2, the spacer 15 is attached to a part of the annular carrier-engagement portion 13*b* in the case of looking at it from above. The spacer can be made of any material as long as the material has stiffness and does not easily deform. A size of the spacer 15 is not restricted as long as the spacer does not become unstable at the time of abutting on the head-body-engagement portion 12*a*. For example, the size of the spacer can be approximately one tenth of the inner diameter of the carrier-engagement portion 13*b*. Moreover, a sectional shape of the spacer 15 is not restricted as long as the spacer is located between the carrier-engagement portion 13*b* and the head-body-engagement portion 12*a*. For example, as shown in FIG. 1, when the spacer is in the shape of pinching the carrier-engagement portion 13*b* and is fixed using screws from above, it is apt to be stable. However, the present invention is not restricted thereto.

As described below, when the carrier 13 is lifted with it inclined, the thickness of spacer 15 is appropriately adjusted, for example, in such a manner that the inclination angle of the carrier is about 0.1 to 1°. The thickness of the spacer 15 is easily adjusted desirably by preparing spacers of various thicknesses in advance and by appropriately changing.

Since the spacer 15 does not contact with the head-body-engagement portion 12*a* during polishing the workpiece, the workpiece can be polished as well as a general polishing head without a change in comparison with a polishing head that does not have the spacer 15 and thus there is no problem regarding polishing quality of the workpiece.

Figure 13:
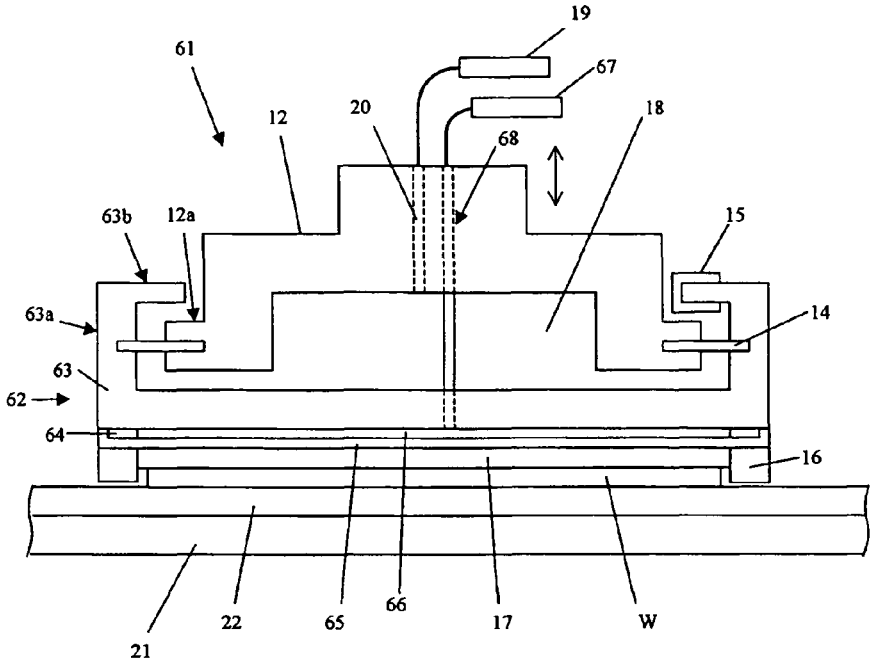
FIG. 13 is a schematic sectional view showing a second embodiment of the polishing head according to the present invention.

FIG. 13 shows the polishing head in which the carrier is a rubber chuck carrier as a second embodiment of the polishing head according to the present invention.

The polishing head 61 mainly comprises the head body 12 and the rubber chuck carrier 62 connected to the head body 12 through diaphragm 14. By the connection through the diaphragm 14, the head body 12 holds the rubber chuck carrier 62, the space portion 18 is sealed and the through hole 20 for pressure adjustment communicating with the pressure adjustment mechanism 19 is provided at the center of the upper part of the head body 12 as well as the foregoing first embodiment.

The rubber chuck carrier 62 has an upper carrier member 63 and a rubber 65, which is bonded to an annular stiff ring 64 made of a stiff material, such as SUS (stainless steel) and the like, with a uniform tension and has a flat lower face. The holding face of the workpiece W is a lower face of the rubber 65. The rubber chuck carrier also has a workpiece-pressing-room 66 in the opposite side of the workpiece holding face of the rubber 65. A fluid is supplied to the workpiece-pressing-room 66 through a fluid-supplying-passage 68 communicating with a pressure adjustment mechanism 67 for pressing the workpiece. A uniform pressure can be applied to the rubber 65 by supplying a pressurized air to the workpiece-pressing-room 66 with the pressure adjustment mechanism 67 for pressing the workpiece and the workpiece can be pressed toward the polishing pad 22 onto the turn table 21 with a uniform pressure. Vacuuming of the workpiece-pressing-room 66 with the pressure adjustment mechanism 67 for pressing the workpiece enables sucking the workpiece W on the rubber 65. Moreover, the backing pad 17 can be provided on the lower face of the rubber 65 and the backing pad 17 can suck the workpiece W. The template 16 can be further provided.

The projecting portion 63*a* and the carrier-engagement portion 63*b* are formed in the upper carrier member 63. As the case of the foregoing first embodiment, the spacer 15 is provided so that the spacer 15 is located at least between the carrier-engagement portion 63*b* and the head-body-engagement portion 12*a* in a part of at least either of the carrier-engagement portion 63*b* or the head-body-engagement portion 12*a*.

Various conventionally known rubber chuck carriers can be adopted in addition to the rubber chuck carrier having a typical structure as described above.

Figure 3:
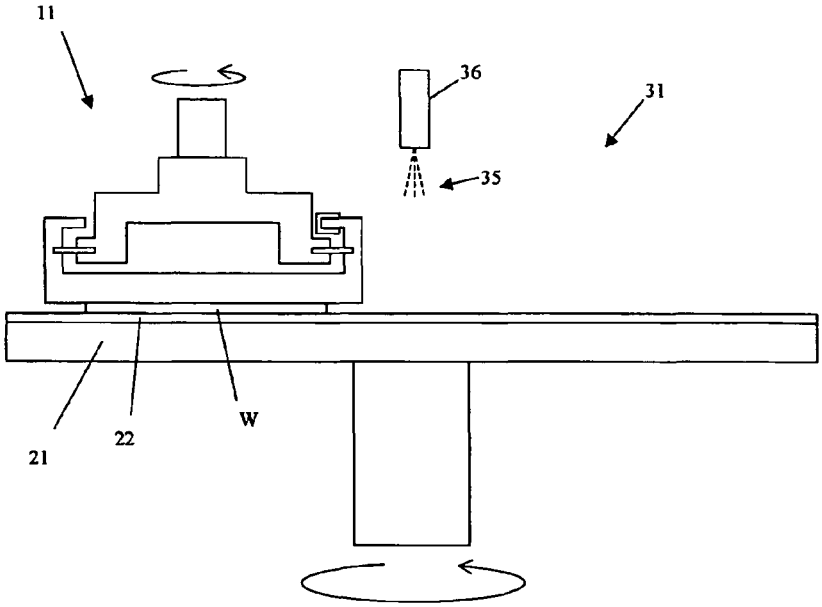
FIG. 3 is a schematic constitutional view showing an example of the polishing apparatus including the polishing head according to the present invention.

FIG. 3 shows an outline of a polishing apparatus 31 provided with the polishing head 11 according the present invention described above. The polishing apparatus 31 comprises the polishing pad 22 attached onto the turn table 21 and a polishing agent supply mechanism 36 for providing a polishing agent 35 to the polishing pad 22 in addition to the polishing head 11.

First, dressing of the polishing pad 22 is performed before polishing the workpiece W using the polishing apparatus 31. This dressing is performed using a usual dresser as usual, as shown in FIG. 7(*a*).

Normally, at least an area where the workpiece is slidably contacted during polishing the workpiece is dressed using the dresser that is larger than the workpiece to be polished.

For example, as the dresser, a wheel dresser 41 is used in which an outer diameter of a portion abutting on the polishing pad 22 is slightly larger than a radius of the turn table 21 and its inner diameter is slightly smaller than the radius of the turn table 21 (for example, in the case of polishing a silicon wafer having a diameter of 300 mm using the turn table having a diameter of 800 mm, the outer diameter of the portion abutting on the polishing pad is about 410 mm and its inner diameter is about 380 mm). With the wheel dresser 41, the dressing is performed by fastening the wheel dresser 41 and rotating the turn table 21 with the wheel dresser abutting on the polishing pad 22. In this case, the wheel dresser 41 can be rotated and swung at an amplitude of approximately one tenth of the radius of the turn table in the direction of the diameter of the turn table 21.

Figure 7:
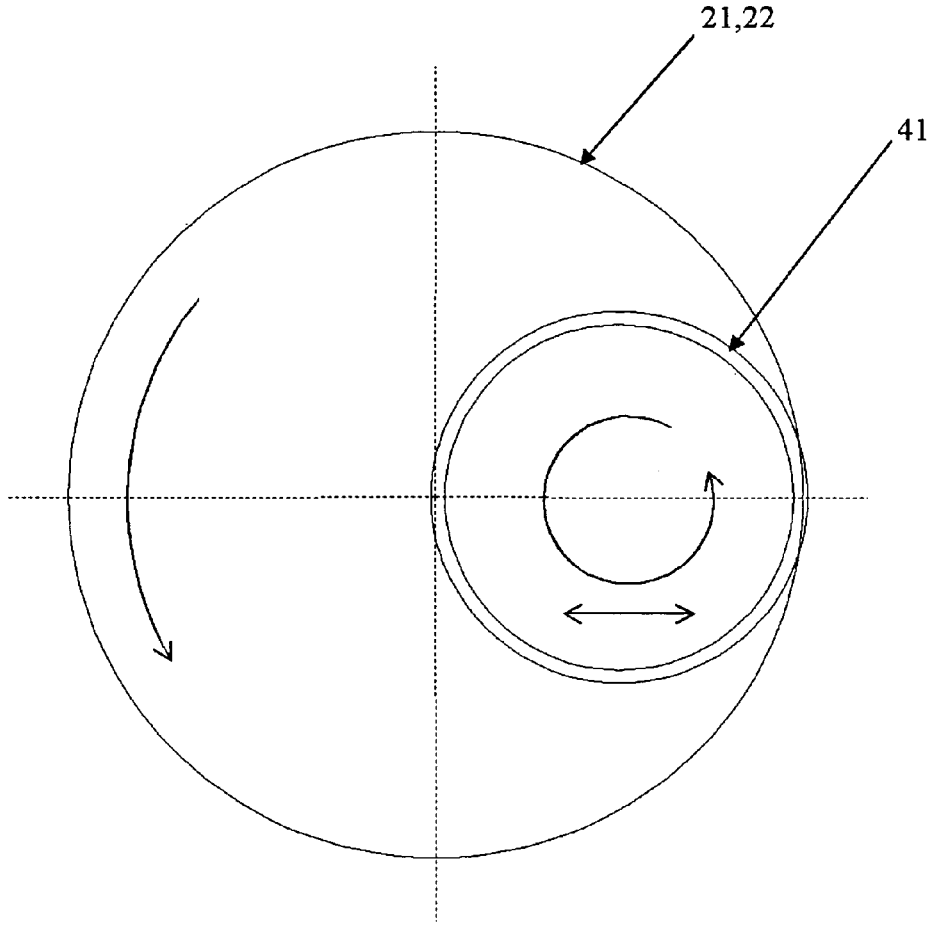
FIG. 7 (*a*) is a schematic plan view showing a manner of dressing and FIG. 7 (*b*) is a graph showing height distribution in the direction of a diameter of the polishing pad after dressing.
Figure 7:
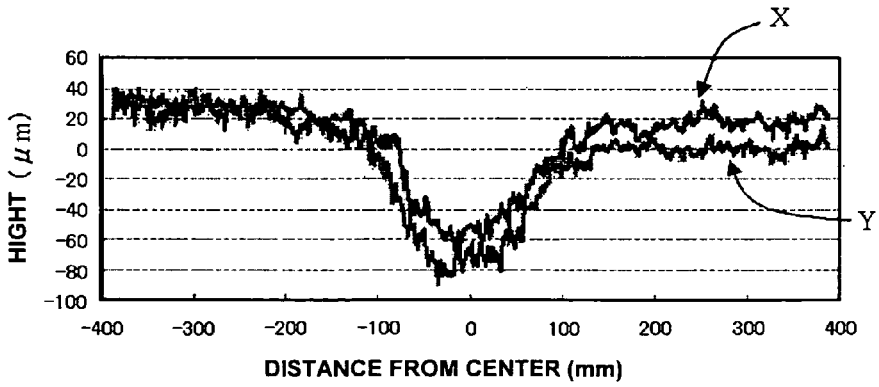

As mentioned above, the present inventors found that when the dressing is performed using a normal method as described above, the center of the polishing pad takes the form of being lower than the periphery and being hollowed as shown in FIG. 7 (*b*). It is to be noted that the graph in FIG. 7 (*b*) shows height distribution of the polishing pad in the direction of the diameter of the turn table and two curves in the graph show height distributions of the polishing pad in the directions of a right angle to one another in an upper plane of the turn table.

It can be considered that this is because swinging time against the dresser in the vicinity of the polishing pad center is longer than that in the periphery when the dressing is performed using the wheel dresser.

After dressing as usual as described above, the workpiece W is polished using the polishing apparatus 31 provided with the polishing head 11 according to the present invention.

When the workpiece W is polished using the polishing apparatus 31, first, the workpiece W is held with the carrier 13, for example, by being attached on the backing pad 17 containing water to hold the back surface of the workpiece W and the edge portion of the workpiece W is held with the template 16.

Then the polishing agent 35 is provided to the polishing pad 22 through the polishing agent supply mechanism 36, while the workpiece W is slidably contacted against the polishing pad 22 with rotating the polishing head 11 and the turn table 21 to each prescribed direction. At this time, the diaphragm 14 can be deformed elastically by adjusting the pressure of the sealed space portion 18 of the head body 12 with the pressure adjustment mechanism 19. For example, by providing compressed air to the space portion 18 from the pressure adjustment mechanism 19, the diaphragm 14 is deformed elastically between the head body 12 and the carrier 13 and the carrier 13 are pressed under prescribed pressure toward the side of the polishing pad 22. In this way, by elastically deforming the diaphragm 14 with pressure adjustment mechanism 19, the front surface of the workpiece W can be polished while the workpiece W held by the carrier 13 is pressed with prescribed pressing force against the polishing pad 22 on the turn table 21 and the workpiece W is rotated in relation to the polishing pad 22.

It is to be noted that the hollow in vicinity of the center of the polishing pad 22 is flattened by pressing force of the workpiece W to the extent that it can be disregarded at the time of polishing the workpiece W, there is no problem regarding polishing quality of the workpiece.

Moreover, the workpiece W can be polished with the polishing head 11 swung at the time of polishing the workpiece W.

After dressing as described above and polishing the workpiece W, the workpiece W is demounted from the polishing pad 22 by the following method.

Figure 6:
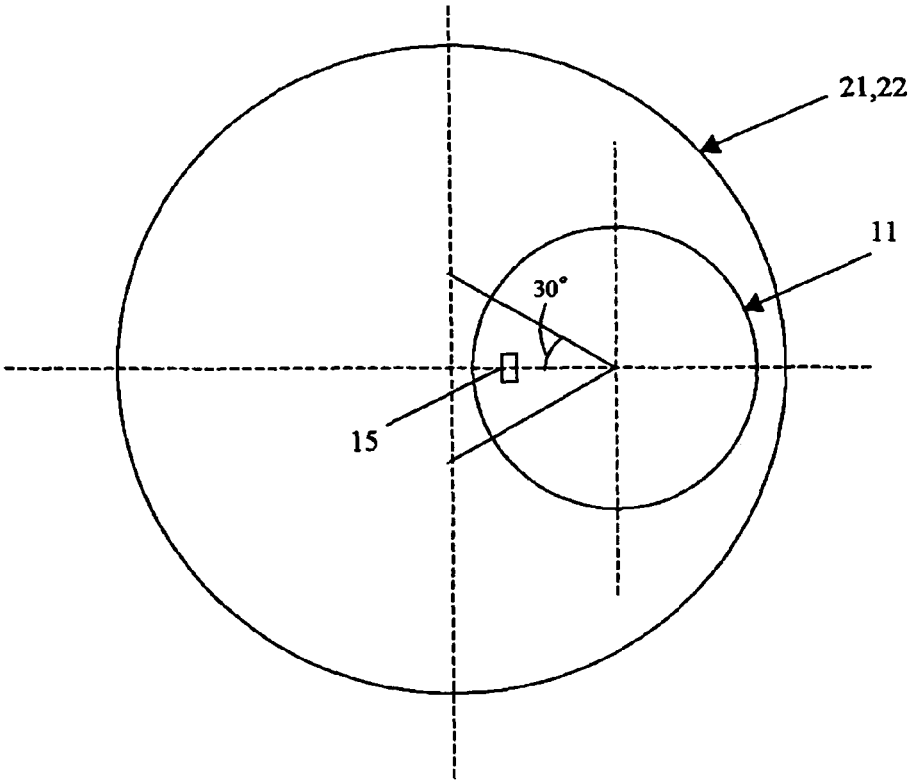
FIG. 6 is an explanatory view showing the case of looking at the stopping position of rotation of the polishing head from above.

First, rotation of the polishing head 11 is stopped in such a manner that the spacer 15 is located in the vicinity of the hollow formed in the center portion of the polishing pad 22. Specifically, as shown in FIG. 6, rotation of the polishing head 11 is stopped in such a manner that the rotational position of the spacer 15 from the center of the polishing head 11 (namely the center of the turn table 21) is within 30° with respect to the center of the polishing pad 22. It is much preferable that the rotational position of the spacer 15 from the center of the polishing head 11 is within 15° with respect to the center of the polishing pad 22 and it is most preferable to locate on a line connecting the center of the polishing head 11 with the center of the polishing pad 22.

A method for stopping the rotational position of the polishing head 11 at the foregoing prescribed position is not restricted, but automatically stopping at the prescribed position is easy and accordingly desirable. Therefore, the polishing apparatus 31 preferably provides with a mechanism for automatically adjusting the stopping position of the rotation of the polishing head 11 (for example, a servo mechanism and the like).

After stopping the rotation of the polishing head 11 as described above, the workpiece W is demounted from the polishing pad 22 by lifting the head body 12 as follows.

Figure 4:
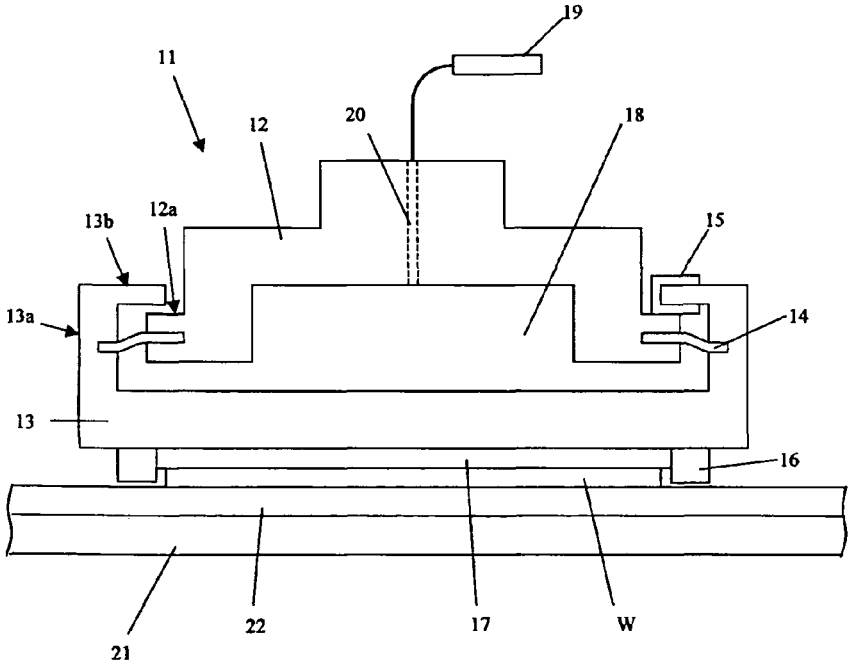
FIG. 4 is a schematic sectional view showing a movement at the time of demounting the workpiece from the polishing pad using the polishing head according to the present invention.

First, as shown in FIG. 4, the head body 12 is lifted and consequently the spacer 15 abuts on the head-body-engagement portion 12*a*. When the lifting force is further applied in this condition, force is concentratively applied to the spacer 15 and force is applied in a focused manner to an area of the workpiece holding face of the carrier 13, the area being in the vicinity just below the spacer 15. When the spacer 15 is located in the vicinity of the center of the polishing pad 22, the vicinity being slightly hollowed, the area of the workpiece holding face of the carrier 13 on which the force focuses is also located in the vicinity of the center of the polishing pad 22, the vicinity being slightly hollowed. Therefore, the workpiece W can be easily and stably demounted from the polishing pad 22.

Figure 5:
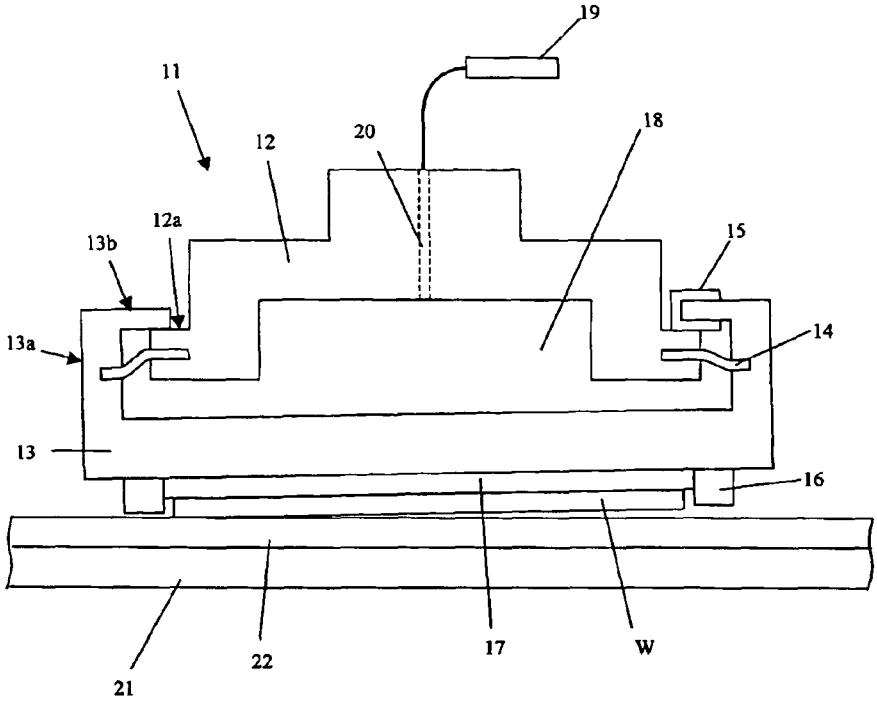
FIG. 5 is a schematic sectional view showing a movement at the time of demounting the workpiece from the polishing pad using the polishing head according to the present invention.

As shown in FIG. 5, when the polishing head is further lifted, the head-body-engagement portion 12*a* abuts on the spacer 15 and on the portion of the annular carrier-engagement portion 13*b* opposite to the spacer 15, and the carrier 13 is lifted with it inclined.

It is to be noted that the thickness of the spacer 15 is appropriately adjusted so as to stably demount the workpiece W from the polishing pad 22. As described above, when the carrier 13 is lifted with it inclined, the thickness of spacer 15 can be adjusted in such a manner that its inclination angle is about 0.1 to 1°.

It is to be noted that unless the workpiece to be polished is notably smaller than the dressing area, since the peripheral portion of workpiece is located on the hollow in vicinity of the center of the polishing pad, the effects of the present invention can be achieved.

Moreover, once the dressing is performed, in the case that the polishing of the workpiece and the demounting from the polishing pad are repeated within normal range without dressing, the effects of the present invention can be also achieved.

Figure 8:
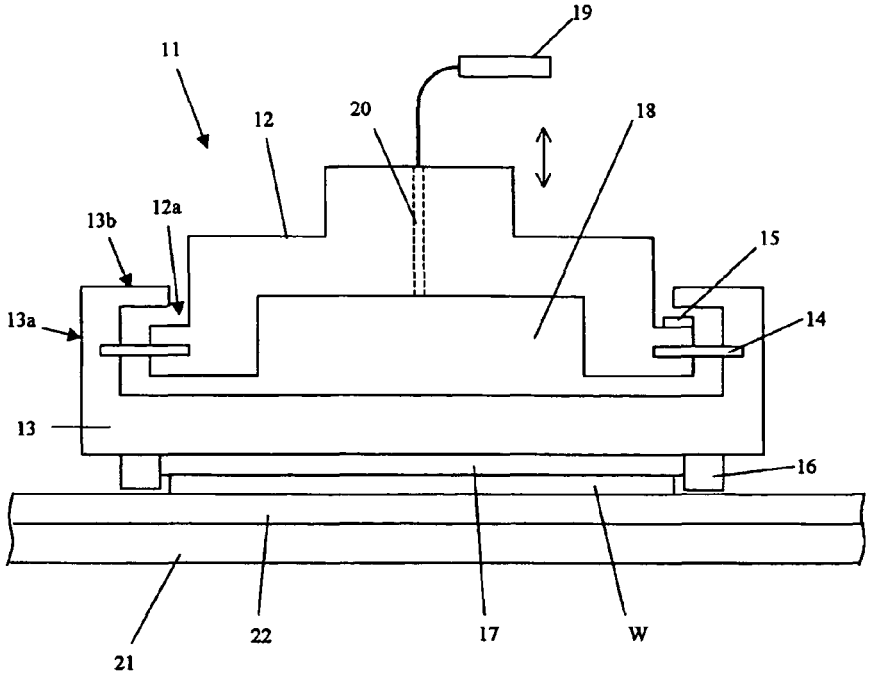
FIG. 8 is a schematic sectional view showing an example of the polishing head having the spacer in the head body.

In the foregoing explanation, the spacer with which the polishing head of the present invention provides is attached to the carrier-engagement portion 13*b*. However, as shown in FIG. 8, the spacer 15 can be attached to the head-body-engagement portion 12*a* or to both of the carrier-engagement portion 13*b* and the head-body-engagement portion 12*a*.

Hereinafter, Examples and Comparative Example of the present invention are explained.

EXAMPLE 1

The polishing head 61 configured as shown in FIG. 13 was manufactured as follows. There were prepared a head body 12 made of stainless steel and a carrier 63 in which the workpiece holding face is the rubber 65, the workpiece-pressing-room 66 is provided at the back of the rubber and a uniform pressure can be applied to the rubber 65 by supplying a pressurized air to the workpiece-pressing-room 66 with the pressure adjustment mechanism 67. They were connected through the diaphragm 14.

A silicon wafer having a diameter of 300 mm and a thickness of 775 μm as the workpiece was polished using the polishing apparatus 31 as illustrated in FIG. 3 provided with the polishing head 61 described above as follows (FIG. 3 shows an embodiment in which the polishing head 11 in FIG. 1 is provided but an embodiment in which the polishing head 61 is provided in this Example). The used silicon wafer was subjected to first polishing on its both faces in advance and its edge portion was also polished. The turn table 21 having a diameter of 800 mm and a usual polishing pad 22 that does not have a groove were used.

First, dressing of the polishing pad 22 was performed before polishing. As the dresser 41, the wheel dresser was used in which an outer diameter of the lower face is 410 mm and an inner diameter of the lower face is 380 mm. The wheel dresser 41 was pressed at a pressure of 30 kPa, the turn table 21 was rotated at 29 rpm and the dressing was performed for 180 minutes.

At the polishing, an alkaline solution containing colloidal silica was used as the polishing agent, and the polishing head 11 and the turn table 21 were rotated at 31 rpm and 29 rpm, respectively. A polishing pressure (pressing force) for the workpiece W was set at 15 kPa. The polishing time was 10 minutes.

After finishing polishing the workpiece, the rotation of the polishing head 11 was stopped in such a manner that the rotational position of the spacer 15 (the thickness is 2 mm) from the center of the polishing head 11 was within 30° with respect to the center of the polishing pad 22. The polishing head 12 was lifted at the rotational position in such a manner that pressure (the pressure of the workpiece-pressing-room 66; sucking pressure) applied between the workpiece W and the sucking face of the carrier 13 (the rubber) became −45 kPa and the workpiece was demounted in 2 seconds.

The polishing and demounting from the polishing pad for 300 workpieces were repeated halfway without dressing.

As a result, 300 out of 300 workpieces were able to be normally demounted (successful rate 100%) and thus the effects of the present invention was clearly obtained.

EXAMPLE 2

The demounting from the polishing pad for 26 workpieces was attempted as with Example 1 except that the rotation of the polishing head was stopped without setting the stopping position of the spacer and the polishing head body 12 was lifted at the rotational position after polishing the workpiece.

As a result, 24 out of 26 workpieces were able to be demounted without a problem but abnormal noise was made in demounting of two workpieces.

COMPARATIVE EXAMPLE 1

As with Example 1, silicon wafers were polished using the polishing apparatus provided with the same polishing head as Example 1 except that the spacer was not provided. The demounting was attempted with a sucking pressure of −30 kPa in 1 to 2 seconds.

As a result, the turn table was lifted and consequently the workpiece was not able to be demounted.

The present invention is not restricted to the foregoing embodiment. The embodiment is just an exemplification, and any embodiments that have substantially the same feature and demonstrate the same functions and influences as those in the technical concept described in claims of the present invention are included in the technical scope of the present invention.

For example, the polishing head according to the present invention is not restricted to the embodiments shown in FIGS. 1, 13. The shape and the like of the polishing head can be appropriately designed except requirements described in claims.

The feature of the polishing apparatus is not also restricted to one shown in FIG. 3. For example, the polishing apparatus can comprise a plurality of the polishing heads according to the present invention.

The invention claimed is:

1. A polishing head having at least a disklike carrier for holding a back surface of a workpiece in which an annular projecting portion that projects upward and an annular carrier-engagement portion that overhangs inward from the projecting portion are formed in a peripheral portion, a head body for holding the carrier in which a space portion is formed inside and an annular head-body-engagement portion that overhangs outward is formed outside, the head body being rotatable, and a diaphragm for connecting the head body with the carrier and sealing the space portion of the head body;

the polishing head holding the back surface of the workpiece with the carrier in condition where pressure of the sealed space portion is adjusted with a pressure adjustment mechanism connected with the space portion in the case of polishing a front surface of the workpiece by bringing into sliding contact with a polishing pad attached onto a turn table, and demounting the workpiece from the polishing pad by lifting the head body and the carrier-engagement portion with the carrier-engagement portion hooked on the head-body-engagement portion in the case of demounting the workpiece from the polishing pad by lifting the polishing head after polishing the workpiece;

wherein a spacer located at least between the carrier-engagement portion and the head-body-engagement portion is provided in a part of the carrier-engagement portion and/or the head-body-engagement portion and the spacer abuts on the carrier-engagement portion and/or the head-body-engagement portion at the time of lifting the head body so that the workpiece is demounted from the polishing pad by lifting the carrier with it inclined in the case of demounting the workpiece from the polishing pad by lifting the polishing head.

2. The polishing head according to claim 1 having a backing pad on a face of the carrier, the face holding the back surface of the workpiece.

3. The polishing head according to claim 2, wherein the carrier is capable of holding a semiconductor wafer having a diameter of 300 mm or more as the workpiece.

4. A polishing apparatus used for polishing a surface of a workpiece at least comprising: a polishing pad attached onto a turn table; a polishing agent supply mechanism for providing a polishing agent to the polishing pad; and a polishing head for holding the workpiece, which is the polishing head according to claim 3.

5. The polishing apparatus accourding to claim 4 having a mechanism for automatically adjusting a stopping position of rotation of the polishing head.

6. A method for demounting a workpiece from a polishing pad after dressing the polishing pad attached onto a turn table and bringing a surface of the workpiece into sliding contact with the dressed polishing pad to polish, comprising the steps of:

holding and polishing the workpiece with the polishing head according to claim 3;

stopping rotation of the polishing head in such a manner that a rotational position of the spacer from a center of the polishing head is within 30° with respect to a center of the polishing pad; and demounting the workpiece by lifting the head body at the rotational position.

7. A polishing apparatus used for polishing a surface of a workpiece at least comprising: a polishing pad attached onto a turn table; a polishing agent supply mechanism for providing a polishing agent to the polishing pad; and a polishing head for holding the workpiece, which is the polishing head according to claim 2.

8. The polishing apparatus according to claim 7 having a mechanism for automatically adjusting a stopping position of rotation of the polishing head.

9. A method for demounting a workpiece from a polishing pad after dressing the polishing pad attached onto a turn table and bringing a surface of the workpiece into sliding contact with the dressed polishing pad to polish, comprising the steps of:

holding and polishing the workpiece with the polishing head according to claim 2;

stopping rotation of the polishing head in such a manner that a rotational position of the spacer from a center of the polishing head is within 30° with respect to a center of the polishing pad; and demounting the workpiece by lifting the head body at the rotational position.

10. The polishing head according to claim 1, wherein the carrier is capable of holding a semiconductor wafer having a diameter of 300 mm or more as the workpiece.

11. A polishing apparatus used for polishing a surface of a workpiece at least comprising: a polishing pad attached onto a turn table; a polishing agent supply mechanism for providing a polishing agent to the polishing pad; and a polishing head for holding the workpiece, which is the polishing head according to claim 10.

12. The polishing apparatus according to claim 11 having a mechanism for Automatically adjusting a stopping position of rotation of the polishing head.

13. A method for demounting a workpiece from a polishing pad after dressing the polishing pad attached onto a turn table and bringing a surface of the workpiece into sliding contact with the dressed polishing pad to polish, comprising the steps of:

holding and polishing the workpiece with the polishing head according to claim 10;

stopping rotation of the polishing head in such a manner that a rotational position of the spacer from a center of the polishing head is within 30° with respect to a center of the polishing pad; and demounting the workpiece by lifting the head body at the rotational position.

14. A polishing apparatus used for polishing a surface of a workpiece at least comprising: a polishing pad attached onto a turn table: a polishing agent supply mechanism for providing a polishing head for holding the workpiece, which is the polishing head according to claim 1.

15. The polishing apparatus according to claim 14 having a mechanism for automatically adjusting a stopping position of rotation of the polishing head.

16. A method for demounting a workpiece from a polishing pad after dressing the polishing pad attached onto a turn table and bringing a surface of the workpiece into sliding contact with the dressed polishing pad to polish, comprising the steps of:

holding and polishing the workpiece with the polishing head according to claim 1;

stopping rotation of the polishing head in such a manner that a rotational position of the spacer from a center of the polishing head is within 30° with respect to a center of the polishing pad; and demounting the workpiece by lifting the head body at the rotational position.

* * * * *